US007315112B2

(12) United States Patent
Kobayashi et al.

(10) Patent No.: US 7,315,112 B2
(45) Date of Patent: Jan. 1, 2008

(54) COLOR CATHODE-RAY TUBE APPARATUS

(75) Inventors: Ryu Kobayashi, Ibaraki (JP); Kenichiro Taniwa, Takatsuki (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 161 days.

(21) Appl. No.: 11/207,564

(22) Filed: Aug. 19, 2005

(65) Prior Publication Data

US 2006/0028116 A1 Feb. 9, 2006

(51) Int. Cl.
*H01J 31/00* (2006.01)

(52) U.S. Cl. ..... 313/440; 313/413; 315/364; 315/391; 315/399

(58) Field of Classification Search ..... 313/440
See application file for complete search history.

(56) References Cited

U.S. PATENT DOCUMENTS 3,097,458 A * 7/1963 Iwasaki ..... 451/8
6,404,117 B1 * 6/2002 Soneda et al. ..... 313/440
7,126,292 B2 * 10/2006 Morimoto et al. ..... 315/399

FOREIGN PATENT DOCUMENTS

JP 57-45650 10/1982
JP 6-283113 10/1994
JP 3097458 1/2004

* cited by examiner

*Primary Examiner*—David Bruce
*Assistant Examiner*—Conrad R. Blease
(74) *Attorney, Agent, or Firm*—Hamre, Schumann, Mueller & Larson, P.C.

(57) ABSTRACT

An insulating frame of a deflection yoke is fixed to a funnel with a metal band and a metal screw. A partition formed so as to be integrated with a holder holding a magnet ring of a CPU includes a first partition provided on a first axis so as to hide the metal screw when the deflection yoke is seen from the holder side along a tube axis, and a second partition provided on a second axis orthogonal to the first axis. A height $H_1$ of the first partition, a height $H_2$ of the second partition, a minimum height $H_{min}$ of the partition, a height $H_M$ of a pull of a magnet ring on a side closest to the deflection yoke, and an outer circumferential edge diameter $R_M$ of the magnet ring excluding the pull satisfy relationships: $H_1>H_2$, $H_M-H_2>10$ mm, and $H_{min}>R_M$. Because of this, a discharge between a metal band and a metal screw that fix the deflection yoke, and a velocity modulation coil can be prevented without decreasing the operability of the rotation adjustment of the magnet ring of the CPU.

4 Claims, 7 Drawing Sheets

COLOR CATHODE-RAY TUBE APPARATUS

BACKGROUND OF THE INVENTION

1. Field of the Invention

The present invention relates to a color cathode-ray tube apparatus.

2. Description of Related Art

A color cathode-ray tube apparatus includes a color cathode-ray tube in which an electron gun is housed in an envelope composed of a panel and a funnel connected to each other, and a deflection yoke provided on an outer circumferential surface of the funnel. Three electron beams emitted from the electron gun are deflected in horizontal and vertical directions by the deflection yoke and scan the phosphor screen formed on an inner surface of the panel.

The deflection yoke includes a horizontal deflection coil generating a horizontal deflection magnetic field and a vertical deflection coil generating a vertical deflection magnetic field, and an insulating frame provided between the horizontal deflection coil and the vertical deflection coil. The insulating frame maintains an electrically insulated state between the horizontal deflection coil and the vertical deflection coil, and supports both the deflection coils. On an outer circumferential surface of a substantially cylindrical portion of an end on the electron gun side of the insulating frame, a substantially Ω-shaped metal band is mounted, and both ends of the metal band are fastened with a metal screw, whereby the deflection yoke is fixed to the funnel.

In such a color cathode-ray tube apparatus, in order to enhance an edge of an image to realize high image quality, a velocity modulation coil is used. The velocity modulation coil is composed of a pair of loop-shaped coils attached to positions of the funnel on the electron gun side from the deflection yoke so as to be opposed to each other in a vertical direction. The velocity modulation coil is allowed to generate a magnetic field in the vertical direction to modulate a horizontal scanning velocity of the electron beams, whereby an edge of an image is enhanced (for example, see JP 57(1982)-45650 Y, JP 6(1994)-283113 A).

Furthermore, in a tube axis direction, a convergence and purity unit (CPU) is placed at a position overlapping the velocity modulation coil. The CPU is composed of dipole, quadrupole, and hexapole magnet rings, and a cylindrical holder provided externally on a neck of the funnel and holding these magnet rings. Each of the dipole, quadrupole, and hexapole magnet rings has a configuration in which two annular magnets are stacked. By adjusting the rotation angle around a tube axis of each magnet ring, the static convergence and purity of the electron beams are optimized.

A conductive film is applied to an inner wall surface of the funnel at a place where the deflection yoke is positioned, and is supplied with a high voltage by anode contact. Thus, when a power source of the color cathode-ray tube apparatus is turned ON/OFF, the above-mentioned substantially Ω-shaped metal band and metal screw, which fix the deflection yoke, are charged from the conductive film supplied with the above-mentioned high voltage, with the funnel and the insulating frame of the deflection yoke being dielectrics, and a discharge (spark) may occur toward the velocity modulation coil placed in the vicinity of the metal band and the metal screw. Such a discharge damages an electric circuit that drives the velocity modulation coil.

In order to prevent the occurrence of the discharge, for example, a method for grounding the above-mentioned substantially Ω-shaped metal band that fixes the deflection yoke through a lead to dissipate a charge is considered.

However, according to this method, it is necessary to connect a lead, which increases the number of components and man-hours, resulting in an increase in a cost.

Furthermore, enlarging a distance in the tube axis direction between the metal band that fixes the deflection yoke and the velocity modulation coil so as to reduce the possibility of the occurrence of a discharge is considered. However, according to this method, the size of the color cathode-ray tube apparatus in the tube axis direction increases. Furthermore, generally, in terms of the enhancement of an image quality, it is considered to be advantageous that the position in the tube axis direction of an end on the phosphor screen side of the velocity modulation coil is as close as possible to the phosphor screen, and hence, the above-mentioned method contradicts this.

Japanese Utility Model Registration No. 3097458 describes that a removable disk-shaped barrier is provided at a holder of the CPU between the metal band and the velocity modulation coil. Japanese Utility Model Registration No. 3097458 describes the following: this barrier inhibits the formation of a discharge path from the metal band to the velocity modulation coil, so that a discharge can be prevented from occurring. Furthermore, Japanese Utility Model Registration No. 3097458 describes the following: by setting the barrier to be a member separate from the holder of the CPU, the barrier can be formed of a conductive resin with a low insulation resistance or metal; consequently, a discharge can be reduced further.

However, the barrier shown in Japanese Utility Model Registration No. 3097458 cannot prevent the occurrence of a discharge sufficiently. This will be described with reference to FIG. 7.

FIG. 7 is a vertical cross-sectional view showing a configuration around the CPU mounted on the neck of the color cathode-ray tube apparatus. This configuration is substantially symmetrical with respect to the tube axis, so that only one side with respect to the tube axis is shown in FIG. 7. Reference numeral 110 denotes a tube axis of a color cathode-ray tube, 120 denotes a neck of a funnel, 130 denotes a deflection yoke mounted on an outer circumferential surface of the funnel, 135 denotes an insulating frame of the defection yoke 130, 137 denotes a metal band that fixes the insulating frame 135 of the deflection yoke 130 to the neck 120, 140 denotes annular magnet rings constituting the CPU, 145 denotes a cylindrical holder holding the magnet rings 140, 150 denotes a velocity modulation coil fitted in grooves 148*a*, 148*b* of the holder 145, and 170 denotes a barrier engaged with the groove 148*a* of the holder 145. A metal screw that fastens both ends of the metal band 137 is not shown.

In the above configuration, when a charge amount accumulated in the deflection yoke 130 exceeds a certain value, a discharge path is formed, which extends from the metal band 137 to the velocity modulation coil 150 in the groove 148*a*, successively passing through an outer circumferential surface of the neck 120, a portion between the neck 120 and an inner circumferential surface of the barrier 170, and a portion between the barrier 170 and the holder 145. Thus, even if the barrier 170 is provided between the metal band 137 and the velocity modulation coil 150, a discharge path with a relatively short creepage distance is formed between the metal band 137 and the velocity modulation coil 150, so that the occurrence of a discharge cannot be prevented completely.

Furthermore, an operation of adjusting the rotation position around the tube axis of the magnet rings 140 of the CPU is performed while an image displayed actually on a screen is being watched. Thus, in the case of placing the barrier 170 for preventing the occurrence of a discharge between the metal band 137 and the velocity modulation coil 150, care should be taken so that the operability of the rotation adjustment of the magnet rings 140 of the CPU placed on an opposite side of the phosphor screen with respect to the barrier 170 is not impaired.

SUMMARY OF THE INVENTION

Therefore, with the foregoing in mind, it is an object of the present invention to provide a color cathode-ray tube apparatus capable of preventing a discharge from occurring between a metal band and a metal screw that fix a deflection yoke, and a velocity modulation coil without decreasing the operability of the rotation adjustment of magnet rings of a CPU.

A color cathode-ray tube apparatus of the present invention includes: a cathode-ray tube including a panel in which a phosphor screen is formed on an inner surface, a funnel connected to the panel, and an electron gun housed in a neck of the funnel; a deflection yoke provided on an outer circumferential surface of the funnel, which deflects an electron beam emitted from the electron gun in a horizontal direction and a vertical direction to allow the electron beam to scan the phosphor screen; a CPU including a substantially cylindrical holder provided externally on the funnel, and a plurality of pairs of annular magnet rings provided on an outer circumferential surface of the holder, at a position on the electron gun side from the deflection yoke in a tube axis direction; and a velocity modulation coil held on the holder.

The deflection yoke includes a horizontal deflection coil deflecting the electron beam in the horizontal direction, a vertical deflection coil deflecting the electron beam in the vertical direction, an insulating frame ensuring insulation between the horizontal deflection coil and the vertical deflection coil, a metal band fixing a cylinder portion provided at an end on the holder side of the insulating frame to the funnel, and a metal screw fastening both ends of the metal band.

The holder includes a partition orthogonal to a tube axis at a position on the deflection yoke side from the velocity modulation coil. The partition is formed so as to be integrated with the holder, and the metal screw is placed on a first axis orthogonal to the tube axis.

The partition includes a first partition provided on the first axis so as to hide the metal screw when the deflection yoke is seen from the holder side along the tube axis, and a second partition provided on a second axis orthogonal to the first axis and the tube axis, and assuming that a height from the tube axis of the first partition is $H_1$, a height from the tube axis of the second partition is $H_2$, a minimum height from the tube axis of the partition is $H_{min}$, a height from the tube axis of a pull for performing a rotation operation around the tube axis, of a pair of first magnet rings placed on a side closest to the deflection yoke among the plurality of pairs of magnet rings is $H_M$, and a distance from the tube axis to an outer circumferential edge of a portion of the pair of first magnet rings excluding the pull is $R_M$, relationships: $H_1>H_2$, $H_M-H_2>10$ mm, $H_{min}>R_M$ are satisfied.

DESCRIPTION OF THE PREFERRED EMBODIMENTS

According to the present invention, a color cathode-ray tube apparatus can be provided, in which a discharge is unlikely to occur between a metal band and a metal screw that fix a deflection yoke, and a velocity modulation coil, without impairing the operability of the rotation adjustment of magnet rings of a CPU.

Figure 1:
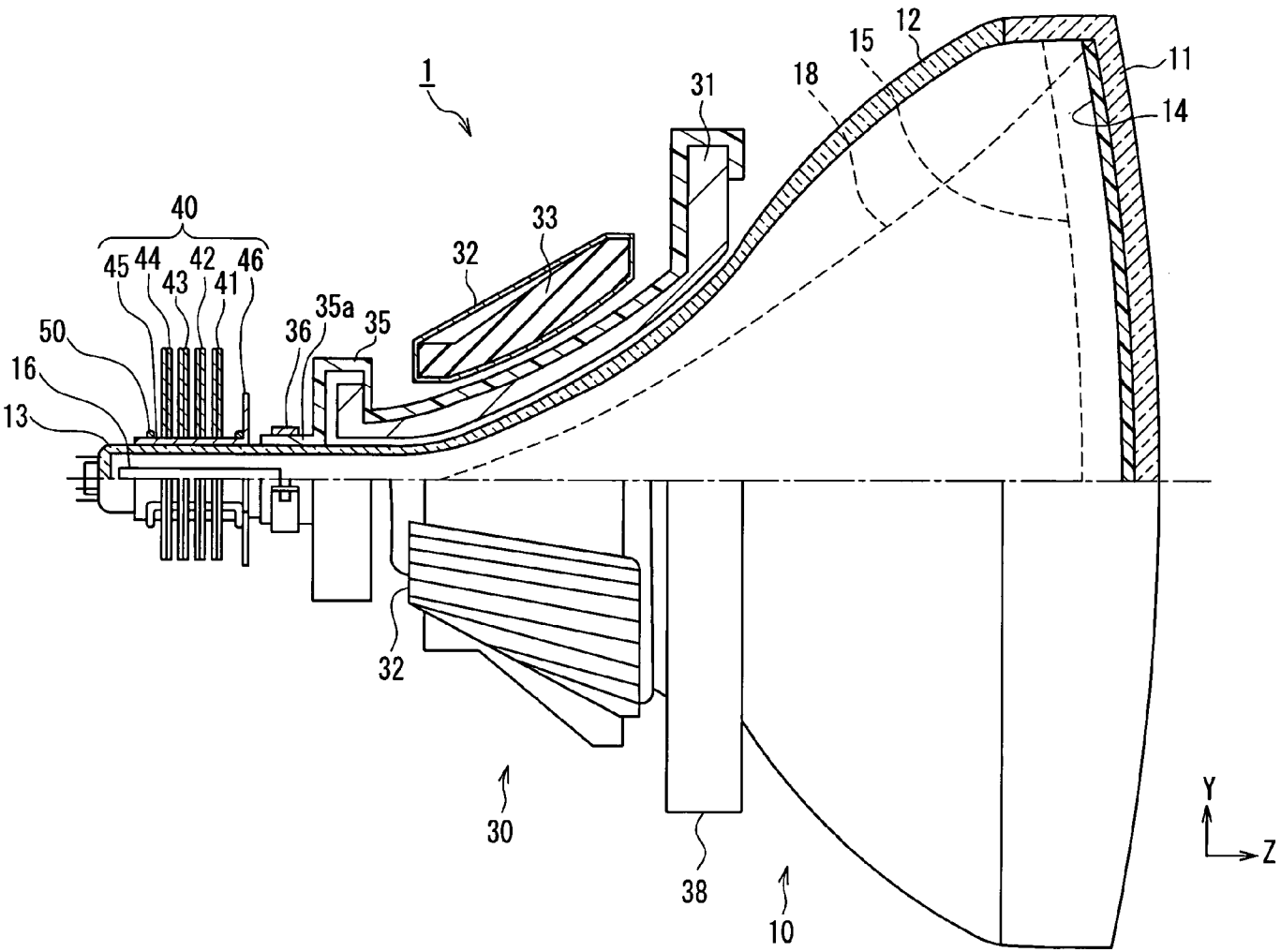
FIG. 1 is a partial cross-sectional view showing a schematic configuration of a color cathode-ray tube apparatus according to one embodiment of the present invention.

FIG. 1 is a partial cross-sectional view showing a schematic configuration of the color cathode-ray tube apparatus 1 according to one embodiment of the present invention. For convenience of the following description, it is assumed that a tube axis is a Z-axis, an axis in a horizontal direction (long-side direction of a screen) is an X-axis, and an axis in a vertical direction (short-side direction of the screen) is a Y-axis. The X-axis and the Y-axis are orthogonal to each other on the Z-axis. In FIG. 1, a cross-sectional view is shown on an upper side from the Z-axis, and an external appearance view is shown on a lower side therefrom.

As shown in FIG. 1, the color cathode-ray tube apparatus 1 includes a color cathode-ray tube 10, a deflection yoke 30, a CPU 40, and a velocity modulation coil 50.

The color cathode-ray tube 10 includes a glass bulb (envelope) composed of a face panel 11 and a funnel 12 connected to each other, a shadow mask 15 attached to an inner side of the face panel 11, and an in-line type electron gun (hereinafter, merely referred to as an "electron gun") 16 housed in a neck 13 of the funnel 12.

On an inner surface of the face panel 11, a phosphor screen 14 is formed in which respective phosphor dots (or phosphor stripes) of red, green, and blue are arranged periodically. The shadow mask 15 is provided at a substantially constant spacing from the phosphor screen 14. A number of electron beam passage apertures are provided in the shadow mask 15. Three electron beams 18 (three electron beams are arranged in a line parallel to the X-axis, so that only one electron beam on the front side is shown in FIG. 1) emitted from the electron gun 16 pass through the electron beam passage apertures provided in the shadow mask 15 to irradiate desired phosphors.

The deflection yoke 30 is provided on an outer circumferential surface of the funnel 12. The deflection yoke 30 includes a saddle-type horizontal deflection coil 31 and a toroidal vertical deflection coil 32, and the vertical deflection coil 32 is wound around a ferrite core 33. The three electron beams 18 emitted from the electron gun 16 are deflected in horizontal and vertical directions by a horizontal deflection magnetic field generated by the horizontal deflection coil 31 and a vertical deflection magnetic field generated by the vertical deflection coil 32, and scan the phosphor screen 14 by a raster scan system. An insulating frame 35 is provided between the horizontal deflection coil 31 and the vertical deflection coil 32. The insulating frame 35 maintains an electrically insulated state between the horizontal deflection coil 31 and the vertical deflection coil 32, and supports both the deflection coils 31, 32.

Figure 2:
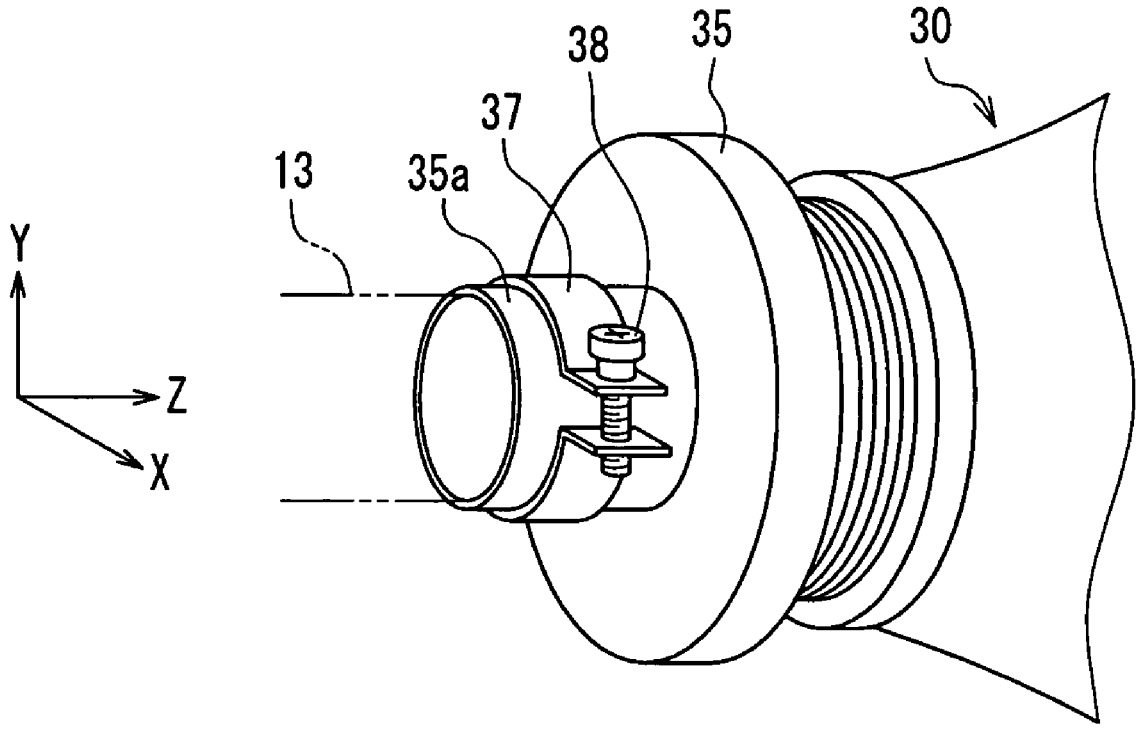
FIG. 2 is a perspective view showing a schematic configuration of an end on an electron gun side of a deflection yoke in the color cathode-ray tube apparatus according to one embodiment of the present invention.

FIG. 2 is a perspective view showing a schematic configuration of an end on the electron gun side of the deflection yoke 30. The insulating frame 35 includes a cylinder portion 35*a* in a cylindrical shape at an end thereof on the electron gun 16 side. At an end of the cylinder portion 35*a*, a slit-shaped notch (not shown) substantially parallel to the Z-axis is formed. On an outer circumferential surface of the cylinder portion 35*a*, a substantially "Ω"-shaped or a substantially "C"-shaped metal band 37 is mounted, and both ends of the metal band 37 are fastened with a metal screw 38. By fastening the metal band 37 with the metal screw 38, the cylinder portion 35*a* can be brought into contact with the neck 13 of the funnel 12. As a result, the deflection yoke 30 can be fixed to the funnel 12. An open end of the metal band 37 and the metal screw 38 fastening the open end are placed on the X-axis.

As shown in FIG. 1, the CPU 40 is provided at a position overlapping the electron gun 16 in the tube axis direction on an outer circumferential surface of the neck 13, and performs static convergence adjustment and purity adjustment of the electron beams 18. The CPU 40 includes a first magnet 41 generating a dipole magnetic field, a second magnet 42 generating a dipole magnetic field, a third magnet 43 generating a quadrupole magnetic field, and a fourth magnet 44 generating a hexapole magnetic field, placed successively from the deflection yoke 30 side. Each of the first to fourth magnets 41, 42, 43, 44 is composed of a pair of annular magnet rings having the same shape and configuration, and are mounted on a substantially cylindrical holder 45 provided externally on the neck 13.

Figure 3A:
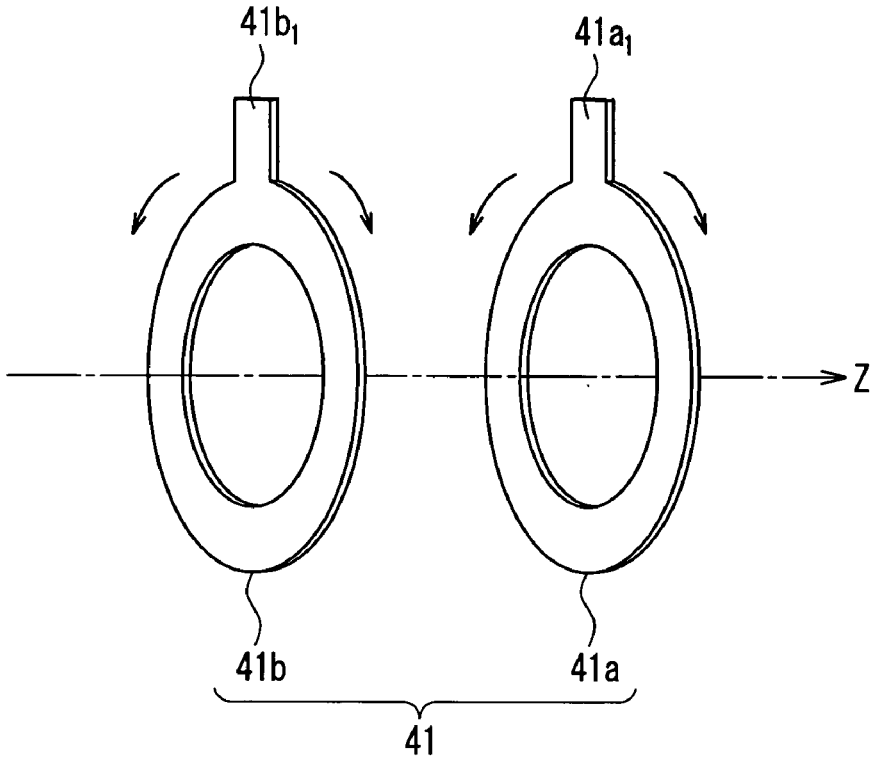
FIG. 3A is an exploded perspective view showing a schematic configuration of annular magnet rings constituting a CPU in the color cathode-ray tube apparatus according to one embodiment of the present invention.
Figure 3B:
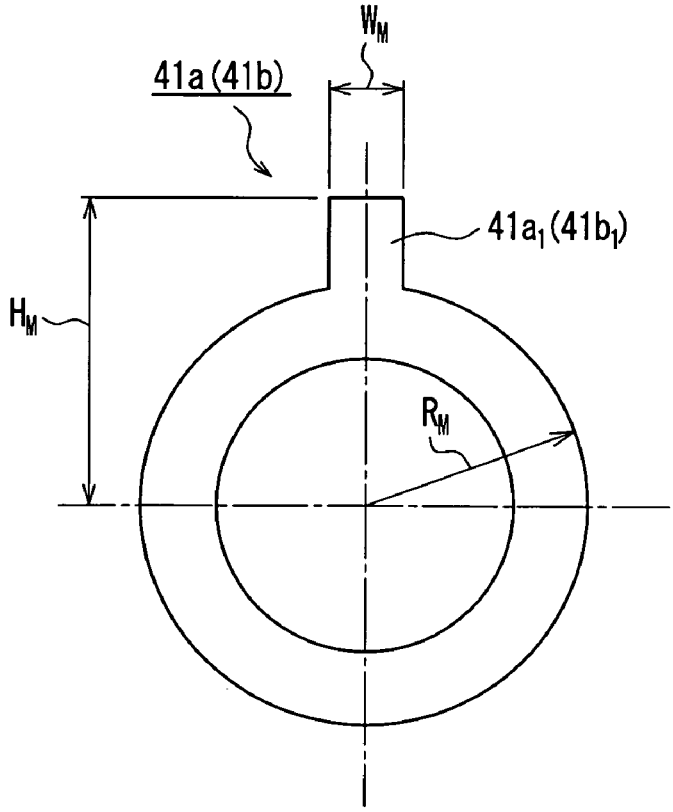
FIG. 3B is a front view of the magnet ring.

FIG. 3A is an exploded perspective view showing a schematic configuration of the first magnet 41. The first magnet 41 is composed of annular magnet rings 41*a*, 41*b* as shown in FIG. 3B. The magnet rings 41*a*, 41*b* are provided externally on the holder 45 under the condition of being in contact with each other in the Z-axis direction. The respective magnet rings 41*a*, 41*b* include pulls $\mathbf{41}a_1$, $\mathbf{41}b_1$ protruding in a radius direction at an outer circumferential edge. By rotating the magnet rings 41*a*, 41*b* respectively around the Z-axis independently, holding the pulls $\mathbf{41}a_1$, $\mathbf{41}b_1$, the direction of a magnetic field generated by each of the magnet rings 41*a*, 41*b* can be changed. By optimizing the rotation position around the Z-axis of each of the magnet rings 41*a*, 41*b* while watching an image displayed on a screen, a desired image can be obtained. In FIGS. 3A and 3B, the first magnet 41 has been exemplified. The second to fourth magnets 42, 43, 44 also have the same outer appearance shape as that of the first magnet 41, although they generate magnetic fields different from that of the first magnet 41.

Figure 4A:
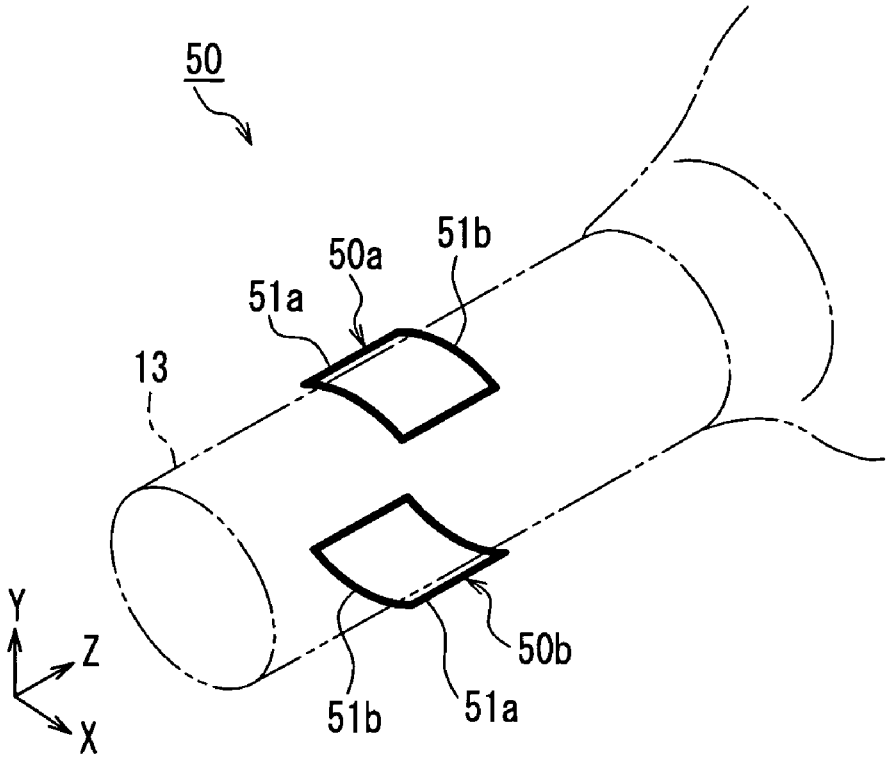
FIG. 4A is a perspective view showing a schematic configuration of a velocity modulation coil in the color cathode-ray tube apparatus according to one embodiment of the present invention.

FIG. 4A is a perspective view showing a schematic configuration of the velocity modulation coil 50. The velocity modulation coil 50 is composed of a pair of loop-shaped coils 50*a*, 50*b* placed with a horizontal plane (XZ-plane) including the Z-axis interposed therebetween. The pair of loop-shaped coils 50*a*, 50*b* are attached to the holder 45 of the CPU 40 at positions substantially symmetrical with respect to the Z-axis. More specifically, the velocity modulation coil 50 is attached to the CPU 40 integrally. A current in accordance with a velocity modulation signal obtained by differentiating a video signal passes through each of the loop-shaped coils 50*a*, 50*b*.

Figure 4B:
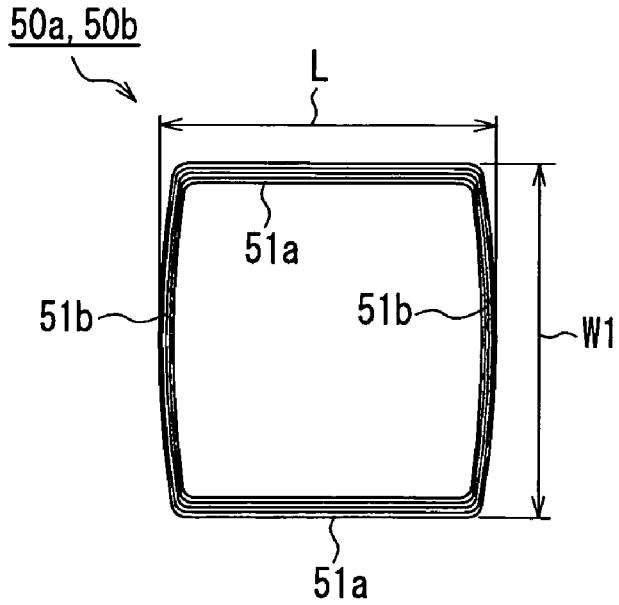
FIG. 4B is a developed view of a loop-shaped coil constituting the velocity modulation coil.

As shown in FIG. 4B, the loop-shaped coils 50*a*, 50*b* have a substantially rectangular shape in a state developed on a plane. Among four sides constituting the loop-shaped coil, a pair of opposed sides (straight portions) 51*a* are placed substantially in parallel to the Z-axis, and a pair of remaining opposed sides (curved portions) 51*b* are placed substantially along an XY-plane while being curved in a substantially arc shape along a curvature of an outer circumferential surface of the holder 45.

Figure 5B:
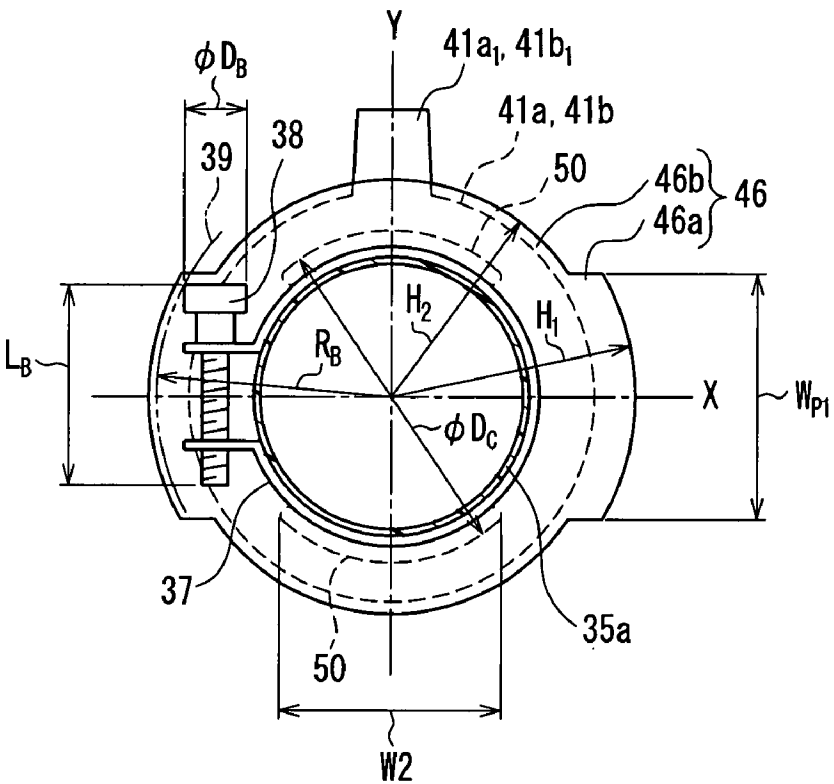
FIG. 5B is a cross-sectional view taken along a line 5B-5B in FIG. 5A.
Figure 5A:
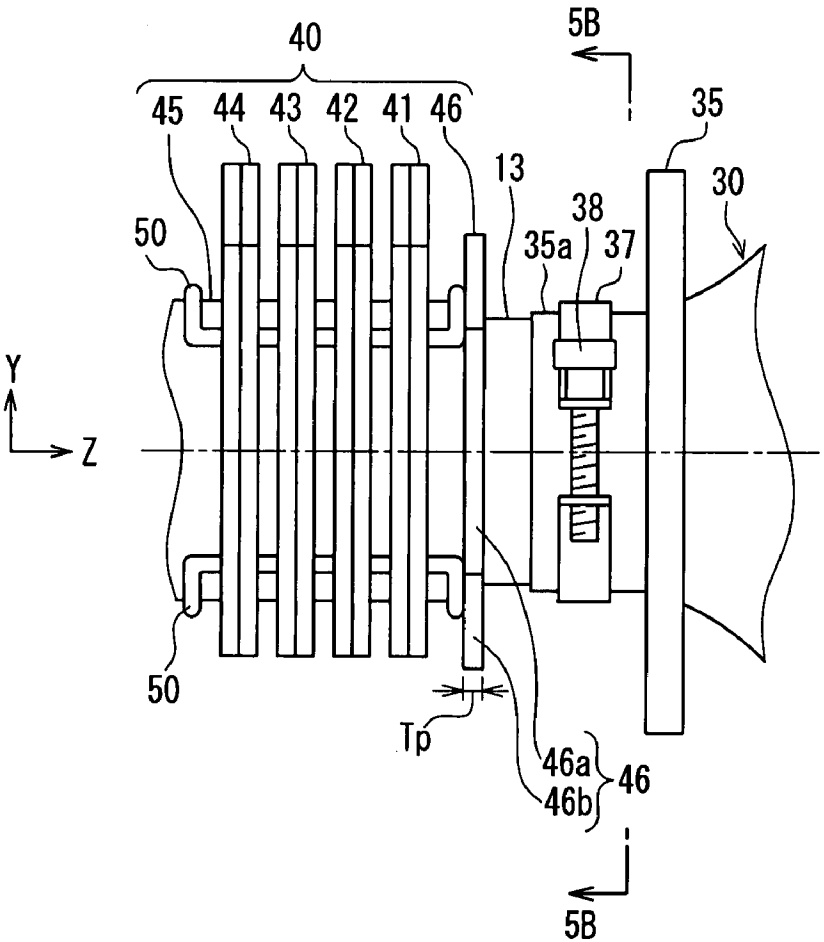
FIG. 5A is a side view around the CPU in the color cathode-ray tube apparatus according to one embodiment of the present invention.

FIG. 5A is a side view around the CPU 40, and FIG. 5B is a cross-sectional view taken along a line 5B-5B in FIG. 5A. In FIG. 5B, the neck 13 and the electron gun 16 placed inside thereof are not shown. The holder 45 includes a partition 46 orthogonal to the Z-axis at a position on the deflection yoke 30 side from the velocity modulation coil 50.

The partition 46 is formed of an insulating material such as resin so as to be integrated with the holder 45. In the conventional configuration shown in FIG. 7, the barrier 170 and the holder 145 are separate members. Therefore, there arises a problem that a discharge path is formed through a slight gap between the barrier 170 and the holder 145. According to the present invention, since the partition 46 and the holder 45 are formed integrally, there is no gap therebetween, and no discharge path is formed therebetween. Thus, a spatial distance (or a creepage distance) between the metal band 37 and/or the metal screw 38 and the velocity modulation coil 50 is enlarged, so that a discharge can be prevented from occurring therebetween.

As shown in FIG. 5B, although the partition 46 is formed over the entire circumference of the holder 45, a distance from the Z-axis to an outer circumferential edge of the partition 46 (hereinafter, a distance from the Z-axis to the outer circumferential edge will be referred to as a "height" of the partition) is not constant. More specifically, the partition 46 is composed of a relatively high first partition 46*a* provided on the X-axis, and a second partition 46*b* that is lower than the first partition 46*a* and provided on the Y-axis.

The function of the partition 46 whose height is not constant will be described with reference to FIGS. 6A and 6B.

Figure 6A:
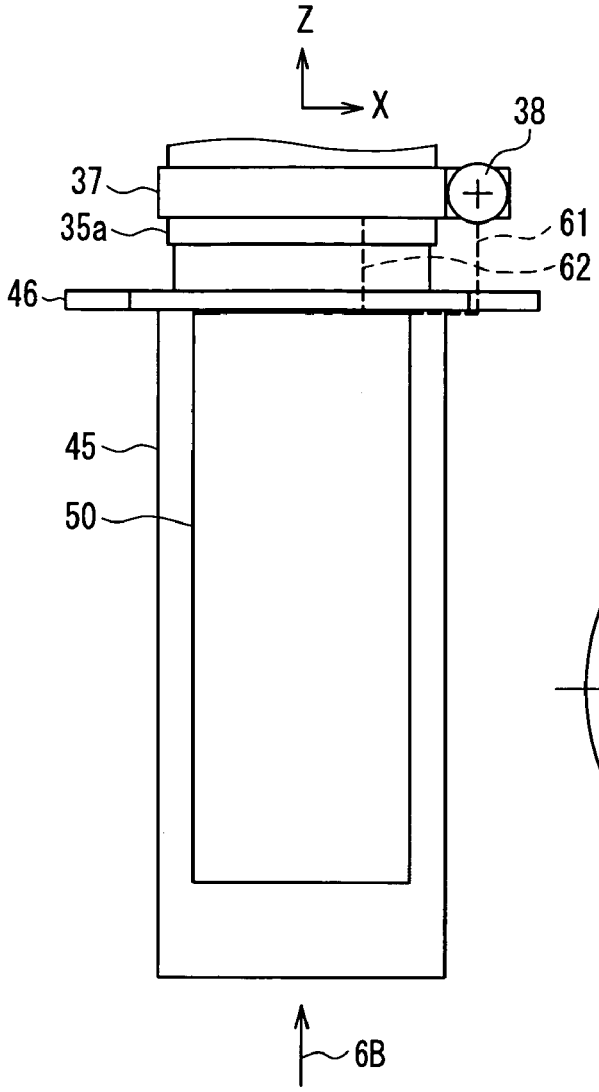
FIG. 6A is a top view around a partition in the color cathode-ray tube apparatus according to one embodiment of the present invention.
Figure 6B:
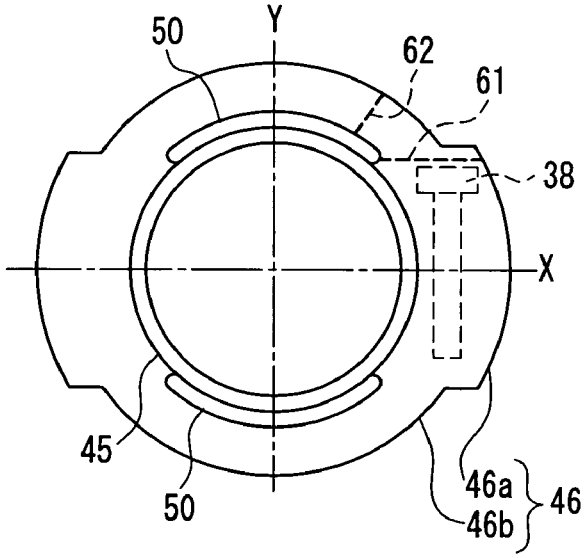
FIG. 6B is a rear view seen along an arrow 6B in FIG. 6A.

FIG. 6A is a top view showing a circumferential configuration of the partition 46, and FIG. 6B is a rear view seen along an arrow 6B in FIG. 6A. For simplicity, in FIGS. 6A and 6B, the first to fourth magnets 41, 42, 43, 44 are not shown.

Figure 7:
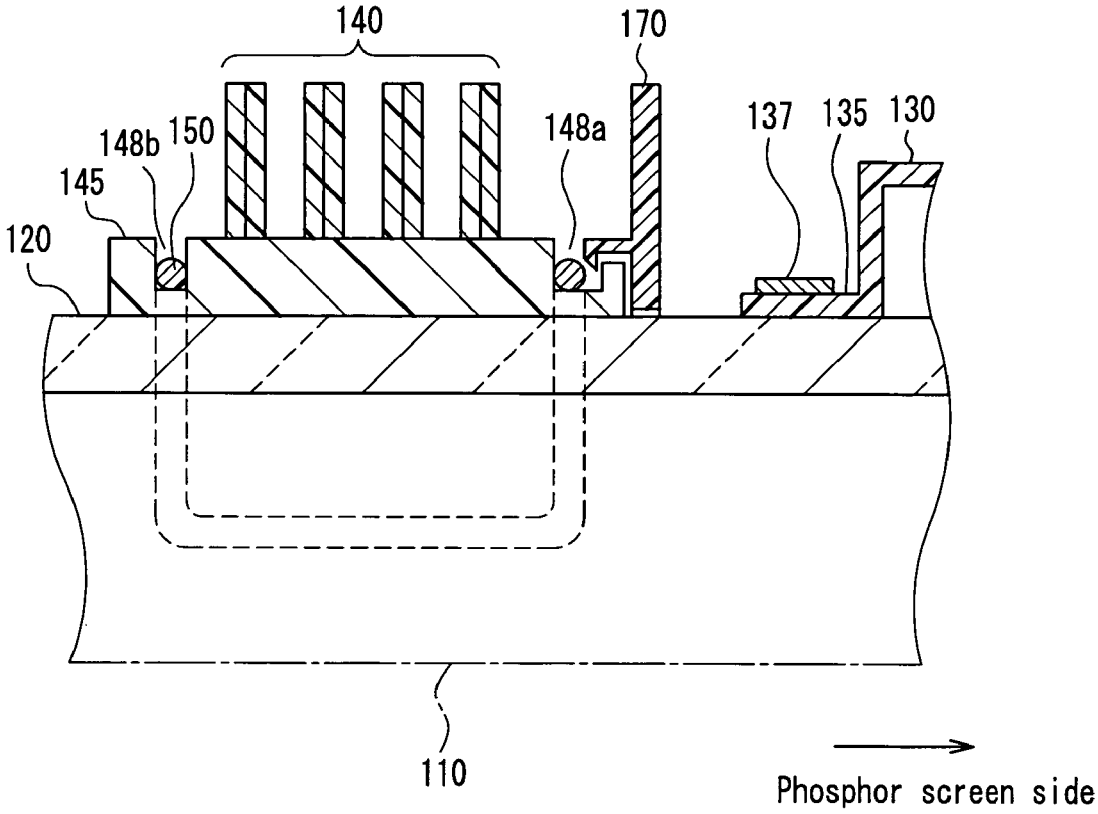
FIG. 7 is a partial cross-sectional view illustrating a discharge in a conventional color cathode-ray tube apparatus in which a removable barrier is mounted on a holder of a CPU.

According to the present invention, the partition 46 and the holder 45 are formed integrally, so that a discharge passing through a portion between the partition 46 and the holder 45 does not occur, unlike the conventional configuration shown in FIG. 7. Even if a discharge occurs in the present invention, the discharge is supposed to pass through a path extending from the metal screw 38 to the velocity modulation coil 50 through the outer side of the outer circumferential edge of the partition 46. However, as shown in FIG. 6B, a height $H_1$ of the first partition 46*a* and a width $W_{P1}$ thereof in the Y-axis direction (see FIG. 5B) are set so that the metal screw 38 as well as the metal band 37 are hidden, when the deflection yoke 30 is seen from the holder 45 side along the Z-axis. Thus, the occurrence of a discharge along a first discharge path 61 passing through the outer side of the outer circumferential edge of the first partition 46*a*, as shown in FIGS. 6A and 6B, can be prevented.

As shown in FIG. 5B, assuming that the height of the first partition 46*a* is $H_1$, and the height of the second partition 46*b* is $H_2$, a relationship: $H_1>H_2$ is satisfied. Thus, the height of the second partition 46*b* provided on the Y-axis is smaller than that of the first partition 46*a*, so that an operation of adjusting the rotation position of each magnet ring of the first to fourth magnets 41, 42, 43, 44 constituting the CPU 40 can be performed easily. In particular, in spite of the fact that the magnet rings 41*a*, 41*b* constituting the first magnet 41 are closest to the partition 46, the partition 46 does not become an obstacle to the adjustment of the rotation position of the magnet rings 41*a*, 41*b*.

Furthermore, as shown in FIG. 3B, assuming that a height from the Z-axis of the pulls $41a_1$, $41b_1$ of the magnet rings 41*a*, 41*b* constituting the first magnet 41 closest to the partition 46 is $H_M$, a relationship: $H_M-H_2>10$ mm is satisfied. Because of this, the pulls $41a_1$, $41b_1$ can protrude significantly from the outer circumferential edge of the second partition 46*b*, so that the partition 46 does not become an obstacle to the adjustment of the rotation position of the magnet rings 41*a*, 41*b* constituting the first magnet 41.

Furthermore, assuming that a minimum value of the height of the partition 46 is $H_{min}$ ($H_{min}=H_2$ in the present embodiment), and a distance (radius of an outer circumferential edge) from the Z-axis to an outer circumferential edge of a portion excluding the pulls $41a_1$, $41b_1$ of the magnet rings 41*a*, 41*b* constituting the first magnet 41 closest to the partition 46 is $R_M$, a relationship: $H_{min}>R_M$ is satisfied. Thus, by defining the minimum value $H_{min}$ of the height of the partition 46, the occurrence of a discharge along a second discharge path 62 (see FIGS. 6A and 6B) extending from the metal band 37 (or the metal screw 38) to the velocity modulation coil 50 through the outer side of an outer circumferential edge of a low portion other than the first partition 46*a* in the partition 46 can be prevented.

In the present invention, it is preferable that the pulls $41a_1$, $41b_1$ of the magnet rings 41*a*, 41*b* constituting the first magnet 41 closest to the partition 46 overlap the second partition 46*b* in terms of the position around the Z-axis, as shown in FIG. 5B, when seen along the Z-axis. Because of this, the protrusion height from the partition 46 of the pulls $41a_1$, $41b_1$ becomes large, so that the partition 46 does not become an obstacle when the pulls $41a_1$, $41b_1$ are held. Accordingly, impairment of the operability of adjusting the rotation position of the magnet rings 41*a*, 41*b* can be prevented. In FIG. 5B, although the pulls $41a_1$, $41b_1$ of the magnet rings 41*a*, 41*b* overlap each other, actually, the rotation positions around the Z-axis of the pulls $41a_1$, $41b_1$ may be different from each other.

Furthermore, according to the present invention, it is preferable that a distance in the Z-axis direction between the metal band 37 and the velocity modulation coil 50 is 10 mm or less. Thus, the velocity modulation coil 50 is close to the deflection yoke 30, whereby the velocity modulation sensitivity of the velocity modulation coil 50 is enhanced, and a clearer image with an edge enhanced can be displayed.

Furthermore, it is preferable that a distance in the Z-axis direction between the metal band 37 and the magnet rings 41*a*, 41*b* constituting the first magnet 41 is 10 mm or less. Thus, the CPU 40 is close to the deflection yoke 30, whereby the degradation of a focus of an electron beam spot generated by adjusting the rotation of each magnet ring of the CPU 40 can be reduced.

In the above embodiment, as shown in FIG. 5B, when seen along the Z-axis, the metal screw 38 and the first partition 46*a* are placed on the X-axis, and the second partition 46*b* is placed on the Y-axis. However, the present invention is not limited thereto. For example, the metal screw 38 and the first partition 46*a* may be placed on the Y-axis, and the second partition 46*b* may be placed on the X-axis. Alternatively, the metal screw 38 and the first partition 46*a* may be placed on one diagonal axis, and the second partition 46*b* may be placed on the other diagonal axis.

Furthermore, in the above embodiment, as shown in FIG. 5B, when seen along the Z-axis, the first partitions 46*a* are provided at two positions so as to be symmetrical with respect to the Z-axis. According to the present invention, the first partition 46*a* may be provided only at a position opposed in the Z-axis direction to the metal screw 38. As shown in FIG. 5B, by providing two first partitions 46*a* at positions symmetrical with respect to the Z-axis, even when the attachment direction of the metal band 37 and the metal screw 38 is rotated by 180° around the Z-axis with respect to the state in FIG. 5B, the metal screw 38 can be opposed to the first partition 46*a*. Therefore, the occurrence of a discharge can be prevented. Thus, the degree of freedom of the attachment direction of the metal band 37 and the metal screw 38 is enhanced during assembly.

In the above embodiment, although the outer circumferential edge of the first partition 46*a* is set to be an arc with a radius $H_1$, and the outer circumferential edge of the second partition 46*b* is set to be an arc with a radius $H_2$, the present invention is not limited thereto. For example, the outer circumferential edge of the first partition 46*a* and/or the second partition 46*b* may be a curve, a straight line, or a combination thereof other than an arc. In this case, it is assumed that the height of the first partition 46*a* is defined by the height along a first axis passing through the tube axis and being substantially orthogonal to a longitudinal direction of the metal screw 38, and the height of the second partition 46*b* is defined by the height along a second axis orthogonal to the tube axis and the first axis.

EXAMPLE

An example will be described in which the present invention was applied to a color cathode-ray tube apparatus with a diagonal size of 29 inches and a deflection angle of 104°.

As the velocity modulation coil 50, loop-shaped coils 50*a*, 50*b* were used, which were obtained by winding a copper wire coated with polyurethane having a wire diameter of 0.4 mm by four turns in a substantially rectangular shape. As shown in FIG. 4B, with the loop-shaped coils 50*a*, 50*b* being developed on a plane as shown in FIG. 4B, a size L along the straight portion 51*a* was set to be 25 mm, and a width W1 (state developed on a plane) along the curved portion 51*b* was set to be 35 mm. When a pair of loop-shaped coils 50*a*, 50*b* were attached to the holder 45 with the curved portions 51*b* bent in a substantially arc shape, in FIG. 5B, an outer diameter $\phi D_C$ of the pair of loop-shaped coils 50*a*, 50*b* was 33.5 mm, and a size W2 thereof in the X-axis direction was about 28 mm. Herein, the outer diameter $\phi D_C$ of the pair of loop-shaped coils 50*a*, 50*b* means the diameter of a virtual cylindrical surface circumscribing the loop-shaped coils 50*a*, 50*b*.

In FIG. 5B, an outer diameter $\phi D_B$ of a head of the metal screw 38 was 7 mm, and a length $L_B$ thereof was 24 mm. Furthermore, when the substantially Ω-shaped metal band 37 mounted on the outer circumferential surface of the cylinder portion 35*a* was fastened with the metal screw 38, a radius $R_B$ of a virtual cylindrical surface (i.e., a circumcircle of the metal band 37 and the metal screw 38 with respect to the Z-axis in FIG. 5B) 39 with respect to the Z-axis, which was in contact with a portion (corner of the head of the metal screw 38 in the present example) farthest from the Z-axis among the metal band 37 and the metal screw 38 was 27.5 mm.

As shown in FIG. 3B, a distance (radius of an outer circumferential edge) $R_M$ from the Z-axis to the outer circumferential edge of an annular portion of the pair of magnet rings 41*a*, 41*b* constituting the first magnet 41 of the CPU 40, excluding the pulls 41$a_1$, 41$b_1$was set to be 22.5 mm, a width $W_M$ of the pulls 41$a_1$, 41$b_1$ was set to be 8 mm, and a distance $H_M$ from the center (Z-axis) of the annular portion to a tip end of the pulls 41$a_1$, 41$b_1$ was set to be 37 mm. An outer size of the pair of magnet rings constituting respectively the second to fourth magnets 42, 43, 44 was set to be the same as that of the pair of magnet rings 41*a*, 41*b*.

In FIG. 5A, a thickness (size in the Z-axis direction) $T_P$ of the partition 46 formed so as to be integrated with the holder 45 at a position of an end on the deflection yoke 30 side of the holder 45 was set to be 1.5 mm. In FIG. 5B, an outer circumferential edge of the first partition 46*a* was set to be an arc having the radius $H_1$ with respect to the Z-axis, and an outer circumferential edge of the second partition 46*b* was set to be an arc having the radius $H_2$ with respect to the Z-axis. The minimum value $H_{min}$ of the height of the partition 46 was equal to $H_2$. A size $W_{P1}$ of the first partition 46*a* in the Y-axis direction was set to be 28 mm.

A distance in the Z-axis direction between the metal band 37 and the velocity modulation coil 50 was 4.0 mm. Furthermore, a distance in the Z-axis direction between the metal band 37 and the magnet ring 41*a* placed on the metal band 37 side of the first magnet 41 was 8.5 mm.

The following two points were evaluated under the condition of variously changing the height $H_1$ of the first partition 46*a* and a height $H_2$ of the second partition 46*b*.

1. Occurrence of Discharge:

When a power source of a color cathode-ray tube apparatus was turned ON/OFF, whether or not a discharge occurred between the metal band 37 or the metal screw 38 and the velocity modulation coil 50 was checked. In the case where a discharge occurred, a discharge path thereof further was inspected. As shown in FIGS. 6A and 6B, the case where a discharge occurred along the first discharge path 61 passing through the outer side of the outer circumferential edge of the first partition 46*a* was defined as "1", and the case where a discharge occurred along the second discharge path 62 passing through the outer side of the outer circumferential edge of the second partition 46*b* was defined as "2".

2. Operability of Rotation Adjustment of Magnet Rings 41*a*, 41*b*:

When the rotation positions of the magnet rings 41*a*, 41*b* constituting the first magnet 41 closest to the partition 46 were adjusted optimally while a displayed image was being observed, whether or not the partition 46 became an obstacle was evaluated. The case where the partition 46 did not become an obstacle was defined as "Satisfactory", and the case where the partition 46 became an obstacle was defined as "Unsatisfactory". After the rotation positions were adjusted optimally, when seen along the Z-axis, the pulls 41$a_1$, 41$b_1$of the magnet rings 41*a*, 41*b* overlapped the second partition 46*b* in terms of the position around the Z-axis.

(Experiment A)

The height $H_2(=H_{min})$ of the second partition 46*b* was changed variously with the height $H_1$ of the first partition 46*a* being constant (26.5 mm). In Experiment A, a relationship: $H_1<R_B$ was satisfied. Therefore, when the deflection yoke 30 was seen from the holder 45 side along the Z-axis, a part of the head of the metal screw 38 was exposed outside from the outer circumferential edge of the first partition 46*a*.

Table 1 summarizes experimental conditions and evaluation results.

TABLE 1

| | Sample No. | | | | | | |
|---|---|---|---|---|---|---|---|
| | A-1 | A-2 | A-3 | A-4 | A-5 | A-6 | A-7 |
| $H_1$ (mm) | 26.5 | 26.5 | 26.5 | 26.5 | 26.5 | 26.5 | 26.5 |
| $H_2$ (mm) | 22.5 | 23.0 | 23.5 | 24.5 | 25.5 | 26.0 | 26.5 |
| $H_M - H_2$ (mm) | 14.5 | 14.0 | 13.5 | 12.5 | 11.5 | 11.0 | 10.5 |
| Occurrence of discharge/path | Yes/1, 2 | Yes/1 | Yes/1 | Yes/1 | Yes/1 | Yes/1 | Yes/1 |
| Operability of rotation position adjustment | Satisfac-tory | Satisfac-tory | Satisfac-tory | Satisfac-Tory | Satisfac-tory | Satisfac-tory | Satisfac-tory |

In the sample No. A-1, a part of the metal screw 38 was exposed outside from the outer circumferential edge of the first partition 46*a*, and a relationship: $H_{min}>R_M$ was not satisfied. In the sample Nos. A-2 to A-7, a part of the metal screw 38 was exposed outside from the outer circumferential edge of the first partition 46*a*. Thus, a discharge occurred in any of these samples.

Furthermore, in any of the sample Nos. A-1 to A-7, a relationship: $H_M-H_2>10$ mm was satisfied, so that the operability of the rotation adjustment of the magnet rings 41*a*, 41*b* was satisfactory.

(Experiment B)

The height $H_2(=H_{min})$ of the second partition 46*b* was changed variously with the height $H_1$ of the first partition 46*a* being constant (27.5 mm). In Experiment B, $H_1$ was equal to $R_B$, so that the head of the metal screw 38 was just hidden by the first partition 46*a* when the deflection yoke 30 was seen from the holder 45 side along the Z-axis.

Table 2 summarizes experimental conditions and evaluation results.

TABLE 2

| | Sample No. | | | | | | | |
|---|---|---|---|---|---|---|---|---|
| | B-1 | B-2 | B-3 | B-4 | B-5 | B-6 | B-7 | B-8 |
| $H_1$ (mm) | 27.5 | 27.5 | 27.5 | 27.5 | 27.5 | 27.5 | 27.5 | 27.5 |
| $H_2$ (mm) | 22.5 | 23.0 | 23.5 | 24.5 | 25.5 | 26.5 | 27.0 | 27.5 |
| $H_M - H_2$ (mm) | 14.5 | 14.0 | 13.5 | 12.5 | 11.5 | 10.5 | 10.5 | 9.5 |
| Occurrence of discharge/path | Yes/2 | No | No | No | No | No | No | No |
| Operability of rotation position adjustment | Satisfactory | Satisfactory | Satisfactory | Satisfactory | Satisfactory | Satisfactory | Unsatisfactory | Unsatisfactory |

In the sample No. B-1, a relationship: $H_{min}>R_M$ was not satisfied, so that a discharge occurred. On the other hand, in the sample Nos. B-2 to B-8, a discharge did not occur.

Furthermore, in the sample Nos. B-1 to B-6 satisfying a relationship: $H_M-H_2>10$ mm, the operability of the rotation adjustment of the magnet rings 41*a*, 41*b* was satisfactory.

(Experiment C)

The height $H_2(=H_{min})$ of the second partition 46*b* was changed variously with the height $H_1$ of the first partition 46*a* being constant (28.5 mm). In Experiment C, relationships: $H_1>R_B$ and $W_{P1}>L_B$ were satisfied, so that the metal screw 38 was hidden completely by the first partition 46*a* when the deflection yoke 30 was seen from the holder 45 side along the Z-axis.

Table 3 summarizes experimental conditions and evaluation results.

TABLE 3

| | Sample No. | | | | | | | | |
|---|---|---|---|---|---|---|---|---|---|
| | C-1 | C-2 | C-3 | C-4 | C-5 | C-6 | C-7 | C-8 | C-9 |
| $H_1$ (mm) | 28.5 | 28.5 | 28.5 | 28.5 | 28.5 | 28.5 | 28.5 | 28.5 | 28.5 |
| $H_2$ (mm) | 22.5 | 23.0 | 23.5 | 24.5 | 25.5 | 26.5 | 27.5 | 28.0 | 28.5 |
| $H_M - H_2$ (mm) | 14.5 | 14.0 | 13.5 | 12.5 | 11.5 | 10.5 | 9.5 | 9.0 | 8.5 |
| Occurrence of discharge/path | Yes/2 | No | No | No | No | No | No | No | No |
| Operability of rotation position adjustment | Satisfactory | Satisfactory | Satisfactory | Satisfactory | Satisfactory | Satisfactory | Unsatisfactory | Unsatisfactory | Unsatisfactory |

In the sample No. C-1, a relationship: $H_{min}>R_M$ was not satisfied, so that a discharge occurred. On the other hand, in the sample Nos. C-2 to C-9, a discharge did not occur.

Furthermore, in the sample Nos. C-1 to C-6 satisfying a relationship: $H_M-H_2>10$ mm, the operability of the rotation adjustment of the magnet rings 41*a*, 41*b* was satisfactory.

The applicable field of the present invention is not particularly limited, and the present invention can be used in a wide range such as a TV receiver and a computer display.

The embodiment as described above is illustrated merely for the purpose of clarifying the technical contents of the present invention. The present invention should not be interpreted only based on such a specific example, can be carried out by being varied within the spirit of the invention and scope of the claims, and should be interpreted in a broad sense.

What is claimed is:

1. A color cathode-ray tube apparatus, comprising:

a cathode-ray tube including a panel in which a phosphor screen is formed on an inner surface, a funnel connected to the panel, and an electron gun housed in a neck of the funnel;

a deflection yoke provided on an outer circumferential surface of the funnel, which deflects an electron beam emitted from the electron gun in a horizontal direction and a vertical direction to allow the electron beam to scan the phosphor screen;

a CPU including a substantially cylindrical holder provided externally on the funnel, and a plurality of pairs of annular magnet rings provided on an outer circumferential surface of the holder, at a position on the electron gun side from the deflection yoke in a tube axis direction; and a velocity modulation coil held on the holder, wherein the deflection yoke includes a horizontal deflection coil deflecting the electron beam in the horizontal direction, a vertical deflection coil deflecting the electron beam in the vertical direction, an insulating frame ensuring insulation between the horizontal deflection coil and the vertical deflection coil, a metal band fixing a cylinder portion provided at an end on the holder side of the insulating frame to the funnel, and a metal screw fastening both ends of the metal band, wherein the holder includes a partition orthogonal to a tube axis at a position on the deflection yoke side from the velocity modulation coil, the partition is formed so as to be integrated with the holder, the metal screw is placed on a first axis orthogonal to the tube axis, the partition includes a first partition provided on the first axis so as to hide the metal screw when the deflection yoke is seen from the holder side along the tube axis, and a second partition provided on a second axis orthogonal to the first axis and the tube axis, and assuming that a height from the tube axis of the first partition is $H_1$, a height from the tube axis of the second partition is $H_2$, a minimum height from the tube axis of the partition is $H_{min}$, a height from the tube axis of a pull for performing a rotation operation around the tube axis, of a pair of first magnet rings placed on a side closest to the deflection yoke among the plurality of pairs of magnet rings is $H_M$, and a distance from the tube axis to an outer circumferential edge of a portion of the pair of first magnet rings excluding the pull is $R_M$, relationships: $H_1>H_2$, $H_M-H_2>10$ mm, $H_{min}>R_M$ are satisfied.

2. The color cathode-ray tube apparatus according to claim 1, wherein the pulls for performing a rotation operation around the tube axis of the pair of first magnet rings overlap the second partition in terms of a position around the tube axis, when seen along the tube axis.

3. The color cathode-ray tube apparatus according to claim 1, wherein a distance in the tube axis direction between the metal band and the velocity modulation coil is 10 mm or less.

4. The color cathode-ray tube apparatus according to claim 1, wherein a distance in the tube axis direction between the metal band and the pair of first magnet rings is 10 mm or less.

* * * * *